US005363663A

United States Patent [19]

Chen

[11] Patent Number: 5,363,663

[45] Date of Patent: Nov. 15, 1994

[54] CHEMICAL WARFARE METHOD WITH INTERMITTENTLY COOLED PROTECTIVE GARMENT

[75] Inventor: Yasu T. Chen, San Antonio, Tex.

[73] Assignee: The United States of America as represented by the Secretary of the Air Force, Washington, D.C.

[21] Appl. No.: 548,454

[22] Filed: Jul. 2, 1990

[51] Int. Cl.[5] ..... F25D 17/02

[52] U.S. Cl. ..... 62/99; 62/259.3; 62/530; 607/104; 607/108

[58] Field of Search ..... 62/259.3, 530, 99, 299, 62/430; 128/379, 402; 600/20

[56] References Cited

U.S. PATENT DOCUMENTS

| | | | |
|---|---|---|---|
| 3,079,765 | 3/1963 | LeVantine | 62/259.3 |
| 3,174,300 | 3/1965 | Webb | 62/430 |
| 3,869,871 | 3/1975 | Rybalko et al. | 62/168 |
| 4,024,730 | 5/1977 | Bell et al. | 62/259 |
| 4,172,454 | 10/1979 | Warncke et al. | 128/142.5 |
| 4,405,348 | 9/1983 | Pasternack | 62/259.3 |
| 4,691,762 | 9/1987 | Elkins et al. | 165/46 |
| 4,807,447 | 2/1989 | Macdonald et al. | 62/259.3 |

*Primary Examiner*—Albert J. Makay
*Assistant Examiner*—John Sollecito
*Attorney, Agent, or Firm*—Gerald B. Hollins; Donald J. Singer

[57] ABSTRACT

A method for performing chemical warfare and similar cleanup activities and apparatus enabling the performance of such activity in high-temperature environments while maintaining safe and worker comfortable body temperatures. The disclosed method and apparatus rely on alternate periods of work and rest with the rest periods being additionally used for worker body temperature regulation such as cooldown. A portable temperature regulated liquid source is provided. Avoidance of worker encumbrance by personally-borne apparatus and the maintenance of non-tethered independent condition during work portions of the operating cycle provide advantages over the most closely related prior methods and apparatus. Human subject test results are also included.

17 Claims, 3 Drawing Sheets

CHEMICAL WARFARE METHOD WITH INTERMITTENTLY COOLED PROTECTIVE GARMENT

RIGHTS OF THE GOVERNMENT

The invention described herein may be manufactured and used by or for the Government of the United States for all governmental purposes without the payment of any royalty.

BACKGROUND OF THE INVENTION

This invention relates to the field of personal cooling and the deployment of combined cooling apparatus and protective clothing garments, during clean-up of chemical warfare agents or other hazardous materials from a zone of contamination.

Air Force ground crew members wearing the military issue chemical warfare defense ensemble are subjected to significantly impaired body heat dissipation capability. The employment of this ensemble in warm or hot environmental conditions, as can be readily anticipated in a combat scenario, is in fact found to increase the thermal burden imposed on an aircraft ground crew member or other worker to the point that physical work performance is severely diminished or terminated. Although backpack and other personal cooling systems are known in the art and have been considered for use in this scenario, the heretofore available systems have been found to have a number of practical shortcomings which preclude their successful application in this and related use environments.

Several examples of prior art personal cooling systems are to be found in the U.S. Patent art; this art includes U.S. Pat. No. 4,691,762 of William Elkins et al, which discloses a personal temperature control system in which a heat exchange garment is connected to a heat exchange fluid source through use of quick release couplings. The Elkins et al patent also contemplates use of the heat exchanger apparatus by a plurality of individuals, each of which may have his own control display unit in order to individually regulate the temperature within his heat exchange garment. The Elkins et al patent also contemplates the use of quick disconnect couplings mounted on an immobile heat exchanger fluid apparatus.

The prior patent systems also include the apparatus disclosed in U.S. Pat. No. 4,024,730 of Richard L. Bell et al, which relates to a cooling and breathing system wherein warm-up of liquid oxygen or other liquefied breathable gas is accomplished in a heat exchanger employing the combination of cooling fluid heated by the body heat of an aircraft crewman combined with ambient air. The Bell et al system also contemplates the use of a pump and rapid disconnect fittings and indicates possible use of the invention to cool an individual working in a warm environment.

Also included in the prior patent devices are several single person cooling systems which are arranged to be borne by the user. Such systems are shown in the patents of A. P. Rybalko et al, U.S. Pat. No. 3,869,871; Ernst Warncke et al, U.S. Pat. No. 4,172,454: A. Pasterhack, U.S. Pat. No. 4,405,348; and J. R. MacDonald et al, U.S. Pat. No. 4,807,447.

None of these prior cooling devices is found to be entirely suitable for use in the chemical warfare clean-up and other extended effort multi-person endeavors which are especially addressed by the apparatus and method of the present invention.

SUMMARY OF THE INVENTION

In the present invention there is provided a multi-man cool liquid system of sufficient thermal capacity as to keep workers occupying an elevated temperature environment and wearing vapor-proof clothing in comfortable thermal equilibrium. In this invention, use of the backpack and other individual cooling arrangements is avoided in favor of a less limiting and human factors considered arrangement wherein a time of uncooled work effort is followed by a combined cool-down and rest period with the overall cycle extending for a relatively long time duration. The system of the present invention is freestanding in nature and can be used in remote or disaster-struck areas where a normal power source is unavailable.

It is an object of the present invention, therefore, to maximally use the natural capabilities of the human physiological system in operating a worker cooling arrangement.

It is another object of the invention to provide a work cycle in which the body temperature of participating workers can be maintained below some predetermined upper safe limit during alternating periods of work and rest activity.

It is another object of the present invention to provide a portable cooling arrangement which may be used by a plurality of workers performing a large-scale and ongoing hazardous clean-up effort.

It is another object of the invention to provide a thermal equilibrium arrangement in which workers can achieve periods of physical rest and body temperature cooling while in the relative safety of protective clothing that is retained in place, i.e., without disrobing.

It is another object of the invention to provide a worker cooling arrangement in which the encumbrance of a backpack unit or other worker-borne apparatus is avoided.

It is another object of the invention to provide an individual worker cooling capability that is greater than most heretofore employed apparatus and capable of assuring effective worker cooldown.

It is another object of the invention to provide a worker heat exchange arrangement which may be used either for removing or adding heat to maintain a desirable body temperature.

It is another object of the invention to provide a worker heat exchange arrangement which may be used in a variety of military and non-military hazardous environment situations such as chemical warfare cleanup and hazardous material cleanup, with the latter class including chemical spill, biological accident, nuclear contamination, and other industrial or commercial events.

It is another object of the invention to provide a portable cooling apparatus which may be used over an extended period of time without the need for complicated and unusual consumed material replacement, i.e., with the simple maintenance of an ongoing fuel supply.

It is another object of the invention to provide a worker temperature maintenance arrangement which conforms to the natural work and rest alternating cycle of persons engaged in heavy and extended physical effort.

Additional objects and features of the invention will be understood from the following description and the accompanying drawings.

These and other objects of the invention are achieved by the method for performing hazardous environment extreme temperature physical work activity comprising the steps of surrounding the worker performing the work activity with an enclosing array of hazardous environment isolating protective clothing garments, engaging the clothing isolated worker with the work activity in a repeating cycle of work performance for a first predetermined time interval and quiescent rest for a second temperature recovery predetermined time interval, communicating thermal equilibrium restoring heat energy with the torso of the worker during the quiescent rest predetermined time intervals, the communicating step including establishing a tether conveyed temporary flow of temperature regulated liquid between a source thereof and a closed circuit path disposed within the torso adjacent interior enclosure of the protective clothing garments during the quiescent rest second temperature recovery predetermined time intervals, and severing the tether conveyance at the end of the temperature recovery second predetermined time intervals thereby enabling reengagement of the worker with a new cycle of the work activity.

DETAILED DESCRIPTION

Figure 1:
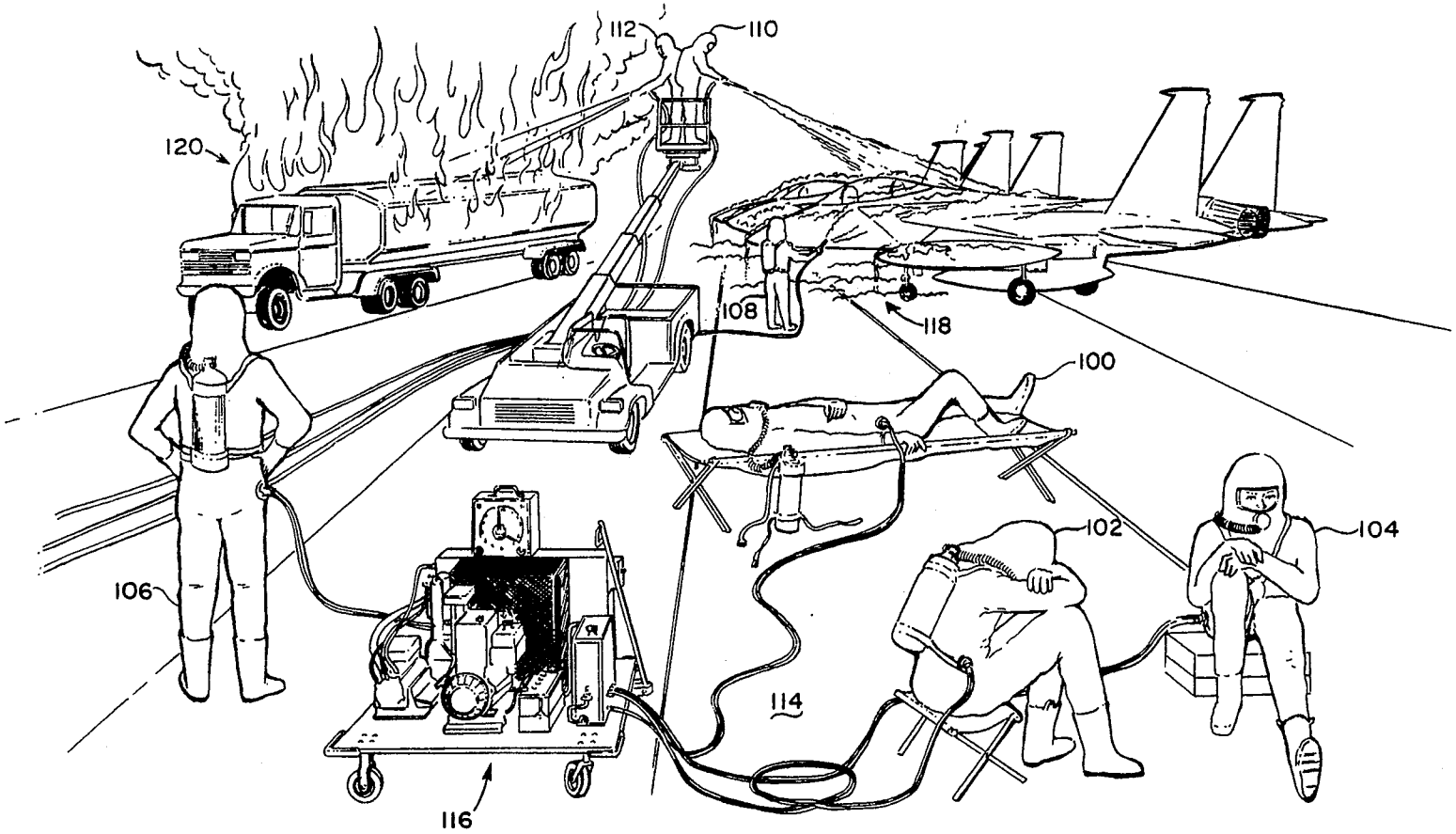
FIG. 1 shows a representative use of the present invention in a military situation.

FIG. 1 in the drawings shows a not-to-scale representative warfare cleanup effort as might be accomplished by Air Force personnel following an enemy action which involves the combination of conventional weapons and chemical warfare agents, and/or biological warfare agents. Efforts of the type shown in FIG. 1 are also to be expected following an accident sequence and the spill of such agents or other hazardous materials. In the FIG. 1 drawing, a plurality of workers are shown to be involved in a variety of activities including equipment washdown and fire fighting that are also accomplished in accordance with the work and rest alternating cycle of the present invention.

In the FIG. 1 drawing, several of the workers, the workers 100, 102, 104, and 106, are shown in postures usable in the rest portion of a work and rest-cooldown cycle of activity according to the present invention. Otherwise in the FIG. 1 drawing, the workers 108, 110, and 112 are engaged in typical protective clothing activities in the work portion of this cycle. The former at rest workers are shown in FIG. 1 to be connected by flexible tether or portable hose apparatus 114 to a source of temperature regulated and pressurized coolant fluid 116, an apparatus which is described with some detail in the paragraphs below herein.

Several aspects of the FIG. 1 represented cleanup effort are significant with respect to the present invention. One of these significant aspects is concerned with the fact that many cleanup efforts, especially cleanups involving military action, are of an extended and multi-person work effort nature, that is, the size and nature of the materials to be cleaned do not respond effectively to short-term, small-scale efforts. Another aspect of these cleanup efforts is that a sizable percentage of the work is of such nature as to require human effort rather than machine performed work activity. Both the feedback of accomplished results and the variety of tasks to be performed suggest such intimate involvement of human persons to provide the most effective cleanup results. Another aspect of the military cleanup effort involves the possible encountering of several hazards in combination, i.e., the fire 120 and the contaminating material 118, so that the effects of one hazard, the fire heat, for example, complicates the other hazard remedial effort. Another aspect of the FIG. 1 cleanup indicates that the work to be performed is often complicated by adverse environmental conditions, particularly the presence of ambient temperatures that are undesirable when combined with the protective clothing necessitated by the material to be cleaned up. The thermal overload condition often encountered when wearing rain protective clothing in the bright sunlight after a summer day shower is a mild common example of the conditions to be expected during many military cleanups.

Another aspect of the FIG. 1 cleanup which may be appreciated with some reflection is that the protective clothing worn by a cleanup worker is removed with such difficulty and hazard to the worker that the wearing of this clothing is preferably accomplished without interruption during all phases of an embarked-upon effort. Removal of the protective clothing for rest or cooldown activities is particularly impractical and therefore suggestive of closed-circuit worker cooling arrangements. Yet another aspect of the FIG. 1 cleanup effort which may be appreciated by persons performing heavy work and physical exercise activity is that there are significant long-term endurance advantages attending the use of an alternating work and rest-cooldown cycle of effort.

To enable the performance of vital cleanup activities in the hostile environment typified by the FIG. 1 scene, as well as to perform other military tasks such as the loading and unloading of aircraft weapons or performance of rapid runway repair in a chemical warfare hot environment, it has been found that the above described alternating cycle of work activity and rest-cooldown is a viable alternative to known temperature maintenance arrangements. In some aspects, this alternating cycle is a significant improvement over the use of backpack temperature regulating systems—particularly when the physical bulk, expendable quantities, and the usual 20 pounds of weight attending such systems is considered. The alternating cycle concept has additionally been found to take advantage of the thermal lag and natural cooling mechanisms of human physiology so as to minimize the amount of external cooling capacity required and decrease the criticality of its tuning. Alternating cycles which range from 45 minutes of work and 15 minutes of rest to 30 minutes of work followed by 30 minutes of rest are, for example, found to be effective in maintaining long-term endurance of workers engaged in cleanup activity.

The source of temperature regulated and pressurized coolant fluid 116 shown in the FIG. 1 cleanup scene is therefore an enabling part of the present invention. A schematic diagram of apparatus suitable for use as a source of temperature regulated and pressurized coolant fluid is therefore shown in FIG. 2 of the drawings.

Quantitive details regarding a preferred arrangement of this apparatus are disclosed in the numeric values of Table I located at the end of this specification. The FIG. 2 apparatus includes a combination of four energy communication circuits which are combined to provide temperature regulated and pressurized coolant fluid for use in a FIG. 1 type of cleanup effort. In the FIG. 2 apparatus is included a gas phase and liquid phase refrigerant circuit which is generally indicated by the number 200, a heat conducting liquid circuit, which is generally indicated by the number 202, an electrical control circuit generally indicated by the number 204, and a mechanical energy transfer circuit that is generally indicated by the number 206.

Figure 2:
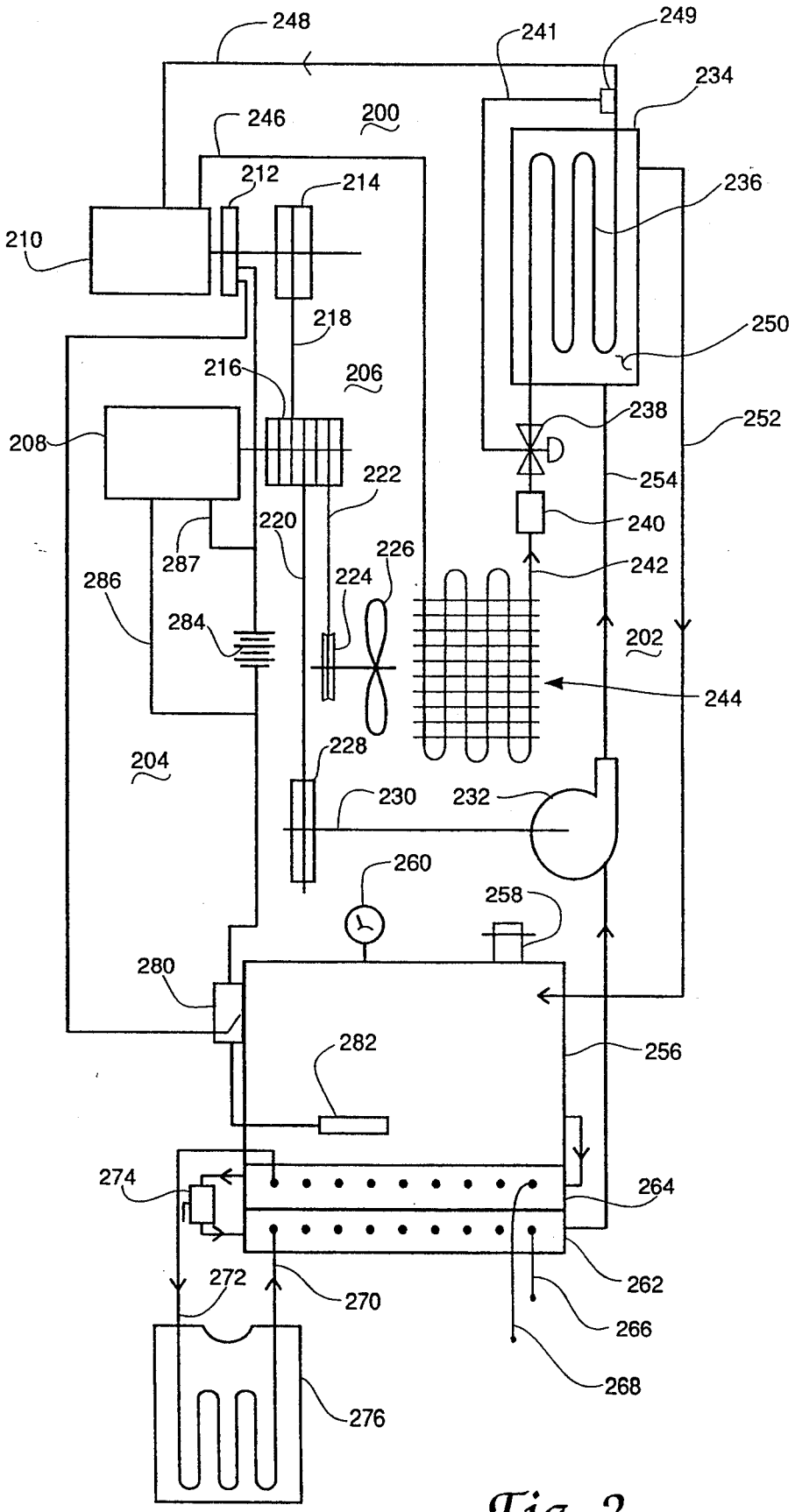
FIG. 2 shows a schematic diagram of cooling apparatus usable in the FIG. 1 activity.

In the mechanical energy transfer circuit 206 of FIG. 2, an internal combustion engine 208 such as a gasoline engine is provided with a pulley 216 which may be of the vee-belt variety. Coupling belts 218 received on the compressor pulley 214, plus the belt 220 to the pump pulley 228, and the belt 222 to the fan pulley 224 are mechanically driven by the engine 208 and pulley 216 combination. The compressor pulley 214 is received on the input shaft of a refrigerant compressor 210 and provides mechanical energization of the compressor 210 by way of an electrically operated slip clutch 212. In a similar manner, the belt 222 and the pulley 224 provide mechanical energization for the fan 226, this energization being most practically made to be continuous in nature so long as the engine 208 is running. In an also similar manner, the belt 220 and the pulley 228 provide continuous rotation by way of the shaft 230 for the liquid circulating pump 232.

In the FIG. 2 pressurized refrigerant gas and liquid circuit 200, the compressor inlet line 248 is used to carry low-pressure refrigerant gas, gas which is preferably of the R-12 or difluorodichloromethane type, from the evaporator coil 236 into the compressor 210, where mechanical energy from the engine 208 is used to raise the pressure and temperature of the gas emerging in the compressor outline line 246. This pressure and temperature elevated gas in the line 246 is communicated to the finned condensing coil 244 where airflow induced by the fan 226 lowers the compressed gas temperature to approximately ambient temperature and thereby transforms the gas into a liquid in the manner which is known in the refrigeration art.

The condensed refrigerant liquid is communicated along the line 242 to a receiver and dryer device 240 where any small traces of moisture or other contaminants are removed and excess quantities of the refrigerant material are stored in liquid form. Liquid from the receiver/dryer device 240 is communicated to the thermal expansion valve 238 where transformation into a cold gas for application to the evaporator coil 236 is accomplished. The expansion from liquid to gas is controlled by a temperature feedback signal originating in a sensing bulb 249, for example, and coupled from the evaporator coil output to the expansion valve control apparatus by the path 241.

The heat conducting liquid circuit 202 in FIG. 2 includes the liquid circulating pump 232 and the pressurized fluid lines 252 and 254 which convey pressurized cooling fluid such as a 50% mixture of ethylene glycol and water to the enclosure 234 surrounding the evaporator coil 236 and thence to the cooled liquid reservoir 256 and the cooled liquid supply manifold 264. The liquid circulating pump 232 also maintains a pressure in the liquid reservoir 256, a pressure indicated by the gauge 260 and controlled by the pressure regulating valve 274. The valve 274 is capable of providing a liquid flow rate between 0.8 and 1.5 liters per minute to each of the protective clothing heat exchanger coil assemblies 276.

Flow in the individual heat exchanger coil 276 may be adjusted by way of the length and diameter of the connecting flexible tubing tethers 270 and 272 and by additional flow controlling valve apparatus which is not shown in FIG. 2, but is known in the art. Additional of the protective clothing heat exchanger coils for additional worker coolant usage may be attached to the flexible tubing tethers 266 and 268 and to the manifold ports indicated to lie between the tethers 270 and 268 on the manifolds 262 and 264. The sizing of the lines 252 and 254 and the manifolds 262 and 264 and the pump 232 is intended to permit connection of up to ten persons to the manifold ports indicated in FIG. 2.

Additional quantities of the cooling fluid may be added to the liquid circuit 202 by way of the filler cap 258 shown in FIG. 2. An additional reservoir and fluid loss compensating apparatus may also be provided for the circuit 202 in order to allow maintenance of the desired operating pressures in the presence of small fluid losses during coupling and uncoupling of the heat exchanger coils 276 in accordance with arrangements which are known in the pressurized fluid art.

A predetermined fixed temperature, preferably a temperature between 45 and 55 degrees Fahrenheit is maintained in the cooled liquid reservoir 256 by way of the electrical control circuit 204 which includes the electrical switch 280 that is operated by a thermostatic sensing bulb 282. Upon rise of the temperature of the liquid in the reservoir 256 above the selected temperature the switch 280 is closed to complete an electrical circuit from the battery 284 through the electrically operated clutch 212 to commence operation of the refrigerant compressor 210. Similarly, falling of the temperature of the reservoir 256 liquid below the selected regulation point causes opening of the switch 280 and disengagement of the clutch 212. The battery 284 is maintained in a fully-charged condition by an alternator-based charging system that is made integral with the engine 208 in the manner known in the engine art. The battery 284 may also be used for cranking or starting of the engine 208 with the electrical leads 286 and 287 being used to indicate the circuit for both cranking and battery charging uses.

The FIG. 2 apparatus therefore provides a fully portable source of cooled liquid that is capable of removing up to 2,000 BTU of heat per hour per person from the ten or less number of protective clothing heat exchanger coils as are indicated at 276 in FIG. 2. Operation of the FIG. 2 apparatus may continue indefinitely over a long period of time so long as fuel is supplied to the engine 208. Moreover, this operation can be largely immune to the hostile nature of the agent being cleaned up in the FIG. 1 scene. The FIG. 2 apparatus may be mounted on a small cart or dolly and have a total weight in the 150 lb. range so that transportation to the scene of a cleanup activity is easily accomplished.

Figure 3:
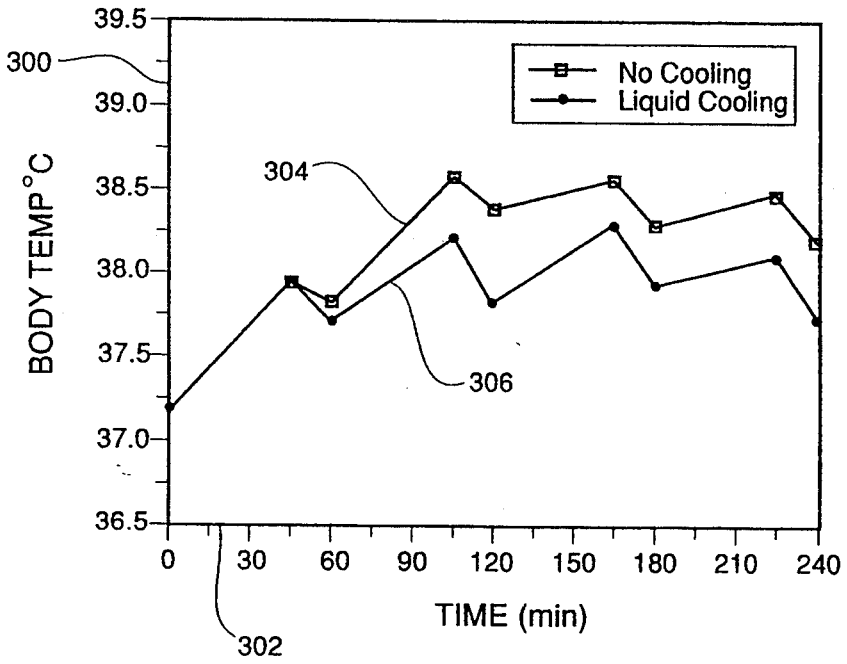
FIG. 3 shows experimental results verifying benefits of the present invention in a moderate environment.
Figure 4:
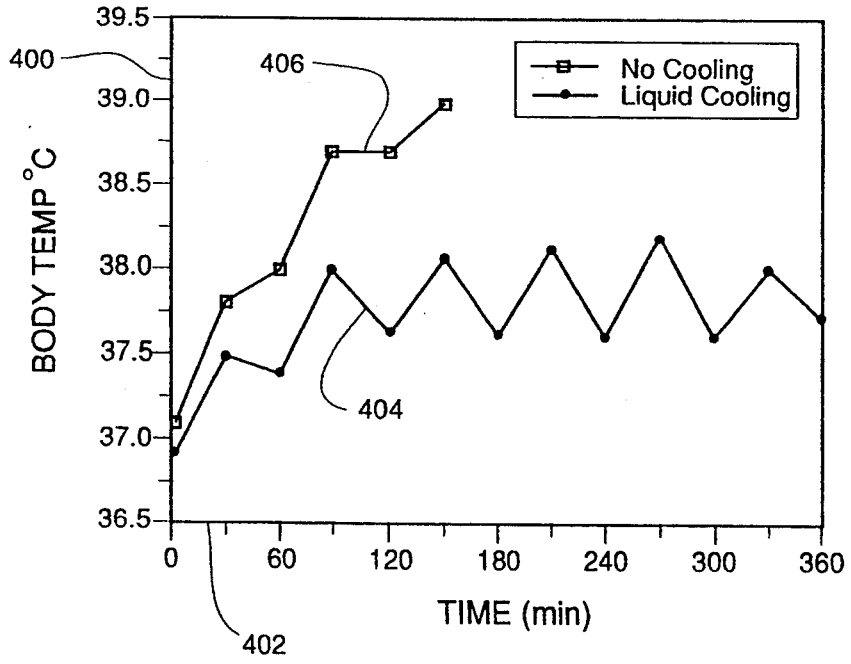
FIG. 4 shows experimental results verifying benefits of the present invention in a hot environment.

FIGS. 3 and 4 of the drawings indicate the results of human subject validation testing of the FIG. 1 and FIG. 2 apparatus in simulated cleanup testing. The testing for the data of these figures was accomplished at the U.S. Air Force School of Aerospace Medicine, Brooks Air Force Base, Tex. In FIG. 3, the curve 304 represents the body temperature of human test subjects exercising on a 6% grade, three miles per hour treadmill for the time of 4 hours. Time is indicated on the scale 302. As indicated by temperatures along the scale 300, the body temperature of test subjects operating in a relatively cool 29° C. (or 89° F.) environment, in a 45 minutes of work and 15 minutes of rest cycle tends to rise from an initial temperature near 37.2° C. to a peak temperature of about 38.6° C. and then to cycle over a range of something under 1° C. during the alternating work and rest cycle. The curve 304 represents the test subject body temperature occurring without the use of FIG. 1 and FIG. 2 cooling. Such cooling is, however, applied for test represented by the curve 306 and as indicated, results in both a lower and a more constant range of body temperatures. The tests indicated in FIG. 3 indicate that a worker can maintain the indicated 45-minute on, 15-minute off work cycle for at least 4 hours and yet experience a body temperature of about 37.8° C.±0.2° C. in the last cycle.

The test results indicated in FIG. 4 represent similar work activity under the more extreme conditions of 38° C. (or 100° F.) environment and for a 30-minute on, 30-minute off cycle of work and rest. As indicated by the curve 406, without benefit of the FIG. 1 and FIG. 2 apparatus, the test subject temperature reached a threatening 39° C. level within 3 hours without benefit of cooling as provided in the present invention. As also indicated in FIG. 4 by the curve 404, the test subject temperature, even under these more extreme conditions, was easily limited to values below 38.25° C. over a 6-hour cycle of work and rest when a FIG. 1 and FIG. 2 type of cooling apparatus was employed. As indicated along the scale 400, body temperature variations of about 0.6° C. are actually experienced with the FIG. 4 indicated work cycle and cooling. It is significant to note, of course, that the results shown in FIG. 3 and FIG. 4 are achieved without continuous use of the FIG. 2 cooling, but with the herein described cycle of time on and time off from the physical effort.

Variations of the described invention will of course, occur to persons skilled in the art; such variations may for example, include the use of an electric motor drive in lieu of the internal combustion engine 208 in FIG. 2, the use of other cooling fluids including, for example, ordinary water, where temperatures can be maintained above freezing; the addition of worker breathing apparatus for cleanup situations requiring such life support, the adjustment of cooling unit sizes and capacities to suit a larger or smaller number of workers, and of course, the use of the FIG. 2 type system in a heat supplying rather than heat dissipating operational mode. In this latter condition, electrically supplied or combustible fuel supplied heat could be used for worker warming in extremely cold climates. The language "communicating heat energy with" is intended herein to mean heat transfer to or from the protected worker as needed.

While the apparatus and method herein described constitute a preferred embodiment of the invention, it is to be understood that the invention is not limited to this precise form of apparatus or method, and that changes may be made therein without departing from the scope of the invention, which is defined in the appended claims.

TABLE I

| Cooling Unit Numeric Values | |
|---|---|
| Cooling capacity - | 20,000 BTU/Hour, 2000 BTU/H/person |
| Cooled Liquid Temperature Range - | 45° F. to 55° F. |
| Cooling Liquid - | Water + Ethylene Glycol 50—50 by Volume |
| Liquid Flow Rate - | 10–15 liters/minute, for 10 persons |
| Typical flow per person - | 0.8 to 1.5 liters/minute |
| Prime Mover - | 8 hp Gasoline/Diesel/Electric Motor |
| Prime Mover RPM - | 2000 |
| Refrigerant Gas - | R12, Difluorodichloromethane |
| Thermal Expansion Valve Type - | Parker N-2FW, ¾–2 tons, −40 to +40° F., 60–175 Psi |
| Steady State Condenser Inlet - Pressure | 150 psig at 116.5° F. ambient |
| Steady State Condenser Outlet - Pressure | 91 psig at 101.5° F. ambient |
| Condenser Fan Identity - | 1/15 HP,16" 4 blade, ⅝ inch bore |
| Fan RPM - | 1100 |
| Compressor Identity - | York Automotive, Mode 206 |
| Compressor RPM - | 1000 |
| Pressure Regulating Valve Identity - | Watts Regulator Co, ½ inch NPT, max 6 GPM |
| Heat Exchanger - | Shell: 2¾ inch D × 35 inch L<br>Refrigerant: Inlet ⅝ inch<br>Outlet 1⅛ inch<br>Pressure Drop: 1–2 Psig |
| Circulating Pump Identity - | Rotary Screw Pump, 1/6 HP Suction and Discharge: ½ inch |
| Total Cooling Unit Weight - | 155 pounds |
| Cooling Unit Physical Size - | 30 inches × 48 inches × 38 inches |

I claim:

1. The method for performing hazardous environment extreme temperature physical work activity comprising the steps of:

surrounding the worker performing said work activity with an enclosing array of hazardous environment isolating protective clothing garments:

engaging said clothing isolated worker in said work activity with a repeating cycle of work performance for a first predetermined time interval and quiescent rest for a second physical and temperature recovery predetermined time interval;

communicating thermal equilibrium restoring heat energy with the torso of said worker during said quiescent rest predetermined time intervals;

said communicating step including establishing a tether conveyed temporary flow of temperature regulated liquid between a source thereof and a torso adjacent closed circuit path disposed within the torso adjacent interior enclosure of said protective clothing garments during said quiescent rest second temperature recovery predetermined time intervals: and severing said tether conveyance at the end of said physical and temperature recovery second predetermined time intervals thereby enabling reengagement of said worker with a new cycle of said work activity.

2. The method of claim 1 wherein said step of communicating heat energy includes removing heat energy from the torso of said worker and wherein said temperature regulated liquid is at a temperature below normal body temperature.

3. The method of claim 2 wherein said repeating cycle first and second predetermined time intervals and said liquid temperature are selected to maintain the body temperature of said worker below a predetermined limit temperature during said work activity first predetermined time intervals.

4. The method of claim 3 wherein said limit temperature is thirty-nine degrees Celsius.

5. The method of claim 2 wherein said first and second predetermined time intervals are equal in duration.

6. The method of claim 5 wherein said time intervals are thirty minutes each in duration.

7. The method of claim 3 wherein said communicating step includes a heat transfer rate between zero and two thousand British Thermal Units per hour.

8. The method of claim 7 wherein said communicating step flow comprises a flow rate between eight-tenths and one and one-half liters per minute and said liquid regulated temperature is between forty-five and fifty-five degrees Fahrenheit.

9. The method of claim 8 wherein said liquid is comprised of water and ethylene glycol.

10. The method of claim 9 wherein said water and ethylene glycol are mixed in the volumetric ratio of fifty percent each.

11. The method of claim 1 wherein said protective clothing is vapor proof in nature.

12. The method of claim 1 wherein said protective clothing is vapor proof and thermally insulating in nature.

13. The method of claim 1 wherein said communicating step source of temperature regulated liquid includes a flow of compressed refrigerating gas.

14. The method of claim 13 wherein said source of temperature regulated liquid includes refrigerating capacity for ten of said workers.

15. The method of claim 14 wherein said source of temperature regulated liquid is portable and self-contained in nature.

16. The method of performing chemical warfare defense cleanup work activity in an elevated temperature environment comprising the steps of:

clothing the worker performing said work activity with a vapor-tight thermally insulating chemical defense warfare protective garment;

engaging said worker in said cleanup work activity with a repeating cycle of work performance for a first thirty-minute time interval and work-free physical rest for a second body temperature lowering thirty-minute time interval: and establishing a temporary tether conveyed eight tenths to one and one-half liter per minute flow of ethylene glycol and water heat communicating solution having a selectable temperature regulation between forty-five and fifty-five degrees Celsius and flowing between a portable gasoline engine powered difluorodichloromethane refrigerating machine source thereof and a plastic tubing defined closed circuit path disposed within said chemical warfare defense protective garment adjacent the torso of said worker, said flow continuing for a worker selected interval up to the duration of said physical rest second thirty-minute time interval.

17. The method of claim 16 further including the step of connecting up to nine additional of said workers to said refrigerating machine source during said second thirty-minute time interval and similarly connecting up to ten additional of said workers during intervening first thirty-minute time intervals.

* * * * *